US006107559A

United States Patent [19]

Weinstock et al.

[11] Patent Number: 6,107,559

[45] Date of Patent: Aug. 22, 2000

[54] METHOD AND APPARATUS FOR REAL-TIME CORRELATION OF A PERFORMANCE TO A MUSICAL SCORE

[75] Inventors: Frank M. Weinstock, Cincinnati, Ohio; George F. Litterst, Newton Centre, Mass.

[73] Assignee: TimeWarp Technologies, Ltd., Rehoboth, Mass.

[21] Appl. No.: 09/293,271

[22] Filed: Apr. 16, 1999

Related U.S. Application Data

[60] Provisional application No. 60/029,794, Oct. 25, 1996.

[51] Int. Cl.[7] ..... G10H 1/36; G10H 7/00

[52] U.S. Cl. ..... 84/634; 84/470 R

[58] Field of Search ..... 84/470 R, 477 R, 84/483.1, 609, 613, 634, 637

[56] References Cited

U.S. PATENT DOCUMENTS

| | | | |
|---|---|---|---|
| 3,243,494 | 3/1966 | Park . | |
| 3,255,292 | 6/1966 | Park . | |
| 3,383,452 | 5/1968 | Park et al. . | |
| 3,522,358 | 7/1970 | Campbell . | |
| 3,553,334 | 1/1971 | Freeman . | |
| 3,629,482 | 12/1971 | Pulfer et al. . | |
| 3,787,601 | 1/1974 | Campbell . | |
| 3,840,691 | 10/1974 | Okamoto . | |
| 3,915,047 | 10/1975 | Davis et al. . | |
| 3,926,088 | 12/1975 | Davis et al. | 84/462 |
| 4,341,140 | 7/1982 | Ishida . | |
| 4,345,501 | 8/1982 | Nakada et al. . | |
| 4,402,244 | 9/1983 | Nakada et al. . | |
| 4,432,266 | 2/1984 | Nakada . | |
| 4,476,764 | 10/1984 | Nishimoto . | |
| 4,484,507 | 11/1984 | Nakada et al. . | |
| 4,745,836 | 5/1988 | Dannenberg . | |
| 5,227,574 | 7/1993 | Mukaino | 84/652 |
| 5,315,911 | 5/1994 | Ochi | 84/477 R |
| 5,347,083 | 9/1994 | Suzuki et al. | 84/613 |
| 5,455,378 | 10/1995 | Paulson | 84/610 |
| 5,521,323 | 5/1996 | Paulson et al. | 84/610 |
| 5,521,324 | 5/1996 | Dannenberg et al. . | |
| 5,629,491 | 5/1997 | Usa | 84/636 |
| 5,693,903 | 12/1997 | Heidorn et al. | 84/609 X |
| 5,792,972 | 8/1998 | Houston | 84/645 |
| 5,952,597 | 9/1999 | Weinstock et al. | 84/609 |

*Primary Examiner*—Jeffrey Donels
*Attorney, Agent, or Firm*—Testa, Hurwitz & Thibeault, LLP

[57] ABSTRACT

The invention relates to a computerized method for correlating a performance, in real time, to a score of music, and a machine based on that method. A score processor accepts a score which a user would like to play and converts it into a useable format. Performance input data is accepted by the input processor and the performance input data is correlated to the score on a note-by-note basis. An apparatus for performing this method includes an input processor that receives input and compares it to the expected score to determine whether an entire chord has been matched, and an output processor which receives a note match signal from the input processor and provides an output stream responsive to the match signals.

20 Claims, 6 Drawing Sheets

METHOD AND APPARATUS FOR REAL-TIME CORRELATION OF A PERFORMANCE TO A MUSICAL SCORE

CROSS-REFERENCE TO RELATED APPLICATION

This application claims priority to provisional patent application Ser. No. 60/029,794, filed Oct. 25, 1996, the contents of which are incorporated herein by reference.

FIELD OF THE INVENTION

The invention involves real-time tracking of a performance in relation to a musical score and, more specifically, using computer software, firmware, or hardware to effect such tracking.

BACKGROUND OF THE INVENTION

Machine-based, i.e. automated, systems capable of tracking musical scores cannot "listen" and react to musical performance deviations in the same way as a human musician. A trained human musician listening to a musical performance can follow a corresponding musical score to determine, at any instant, the performance location in the score, the tempo (speed) of the performance, and the volume level of the performance. The musician uses this information for many purposes, e.g., to perform a synchronized accompaniment of the performance, to turn pages for the performer, or to comment on the performance.

However, it is often difficult to practice a musical piece requiring the participation of a number of different musical artists. For example, a pianist practicing a piano concerto may find it difficult to arrange to have even a minimal number of musical artists available whenever he or she desires to practice. Although the musical artist could play along with a prerecorded arrangement of the musical piece, the artist may find it difficult to keep up with the required tempo while learning the piece. Also, the performer is restrained from deviating, from the prerecorded arrangement, for expressive purposes. For example, if the performer changes tempo or volume, the prerecorded arrangement does not vary in speed or volume to match the performance. Further, it is often tedious to search an entire prerecorded piece of music for the particular segment of the work requiring practice.

Accordingly, there is a need for an automated system which can track a musical score in the same manner, i.e. correlating an input performance event with a particular location in an associated musical score. This allows a musician to perform a particular musical piece while the system: (i) provides a coordinated audio accompaniment; (ii) changes the musical expression of the musician's piece, or of the accompaniment, at predetermined points in the musical score; (iii) provides a nonaudio accompaniment to the musician's performance, such as automatically displaying the score to the performer; (iv) changes the manner in which a coordinated accompaniment proceeds in response to input; (v) produces a real-time analysis of the musician's performance; or (vi) corrects the musician's performance before the notes of the performance become audible to the listener.

SUMMARY OF THE INVENTION

It is an object of this invention to automate the score tracking process described above, making the information available for whatever purpose is desired—such as an automatic performance of a synchronized accompaniment or a real-time analysis of the performance.

A comparison between a performance input event and a score of the piece being performed is repeatedly performed, and the comparisons are used to effect the tracking process. Performance input may deviate from the score in terms of the performance events that occur, the timing of those events, and the volume at which the events occur; thus simply waiting for events to occur in the proper order and at the proper tempo, or assuming that such events always occur at the same volume, does not suffice. In the case of a keyboard performance, for example, although the notes of a multi-note chord appear in the score simultaneously, in the performance they will occur one after the other and in any order (although the human musician may well hear them as being substantially simultaneous). The performer may omit notes from the score, add notes to the score, substitute incorrect notes for notes in the score, play notes more loudly or softly than expected, or jump from one part of the piece to another; these deviations should be recognized as soon as possible. It is, therefore, a further object of this invention to correlate a performance input to a score in a robust manner such that minor errors can be overlooked, if so desired.

Another way performance input may deviate from a score occurs when a score contains a sequence of fairly quick notes, e.g., sixteenth notes, such as a run of CDEFG. The performer may play C and D as expected, but slip and play E and F virtually simultaneously. A human would not jump to the conclusion that the performer has suddenly decided to play at a much faster tempo. On the other hand, if the E was just somewhat earlier than expected, it might very well signify a changing tempo; but if the subsequent F was then later than expected, a human listener would likely arrive at the conclusion that the early E and the late F were the result of uneven finger-work on the part of the performer, not the result of a musical decision to play faster or slower.

A human musician performing an accompaniment containing a sequence of fairly quick notes matching a similar sequence of quick notes in another musician's performance would not want to be perfectly synchronized with an uneven performance. The resultant accompaniment would sound quirky and mechanical. However, the accompaniment generally needs to be synchronized with the performance.

Also, a performer might, before beginning a piece, ask the accompanist to wait an extra long time before playing a certain chord; there is no way the accompanist could have known this without being told so beforehand. It is still a further object of this invention to provide this kind of accompaniment flexibility by allowing the performer to "mark the score," i.e., to specify special actions for certain notes or chords, such as waiting for the performer to play a particular chord, suspending accompaniment during improvisation, restoring the tempo after a significant tempo change, ignoring the performer for a period of time, defining points to which the accompaniment is allowed to jump, or other actions.

In one aspect, the present invention relates to a method for real-time tracking of a musical performance in relation to a score of the performed piece. The method begins by receiving each note of a musical performance as it is played. For each note received, a range of the score in which the note is expected to occur is determined and that range of the score is scanned to determine if the received note matches a note in that range of the score.

In another aspect, the present invention relates to an apparatus for real-time tracking of a musical performance in relation to a score of the performed piece which includes an input processor, a tempo/location/volume manager, and an output manager. The input processor receives each note of a performance as it occurs, stores each received note together with information associated with the note in a memory element, and compares each received note to the score of the performed piece to determine if the received note matches a note in the score. The output manager receives a signal from the input processor which indicates whether a received note has matched a note expected in the score and that provides an output stream responsive to the received signal.

In yet another aspect, the present invention relates to an article of manufacture having computer-readable program means for real-time tracking of a musical performance in relation to a score of the performed piece embodied thereon. The article of manufacture includes computer-readable program means for receiving each note of a musical performance, computer-readable means for determining a range in the score in which each received note is expected to occur, and a computer-readable means for determining if each received note occurs in the range determined for it.

BRIEF DESCRIPTION OF THE DRAWINGS

The invention is pointed out with particularity in the appended claims. The advantages of this invention described above, as well as further advantages of this invention, may be better understood by reference to the following description taken in conjunction with the accompanying drawings, in which:

DETAILED DESCRIPTION OF THE INVENTION

General Concepts

Figure 1A:
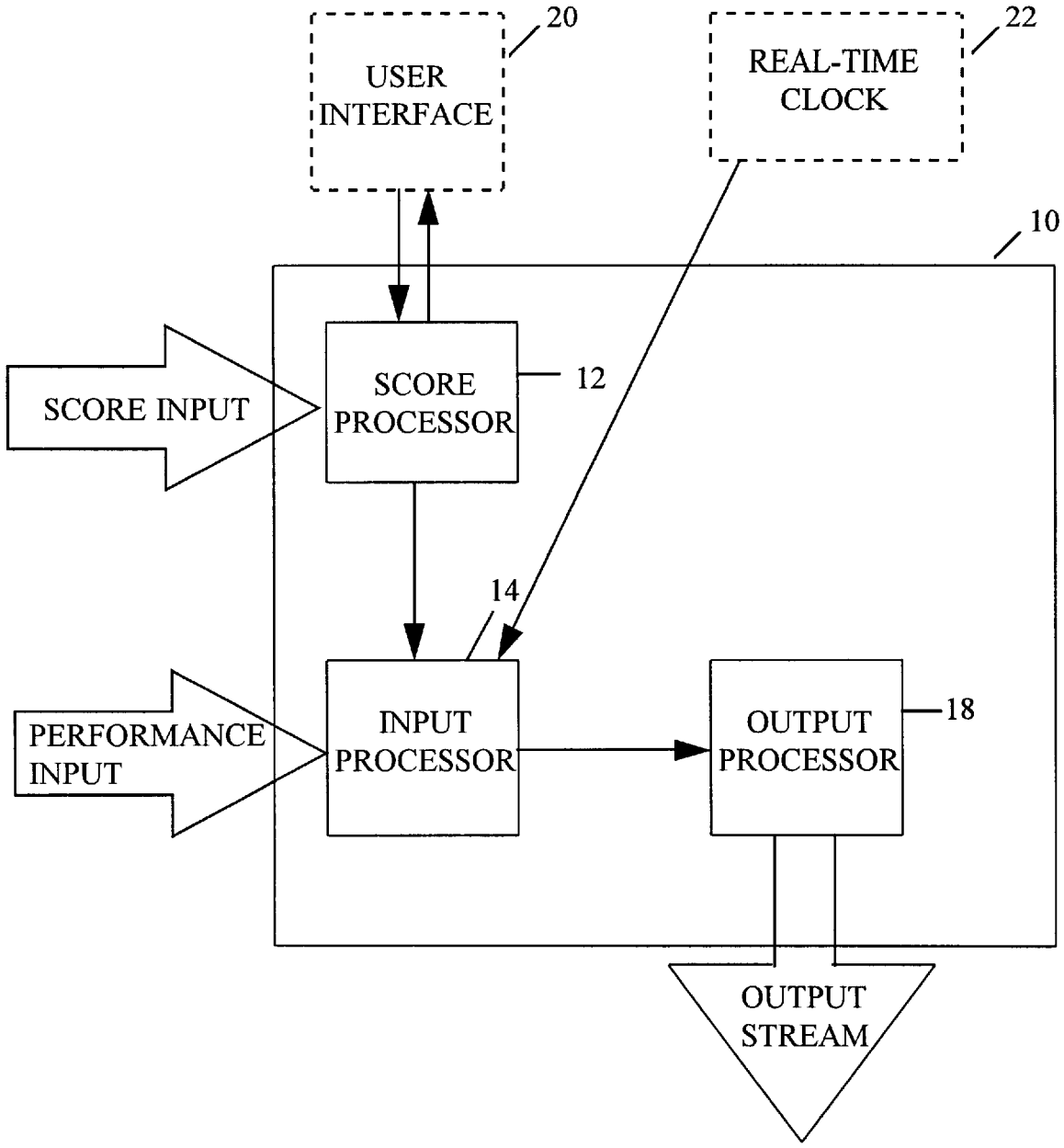
FIG. 1A is a functional block diagram of an embodiment of an apparatus for correlating a performance to a score.

Before proceeding with a detailed discussion of the machine's operation, the concepts of time and tempo should be discussed. There are essentially two time streams maintained by the machine, called RealTime and MusicTime, both available in units small enough to be musically insignificant (such as milliseconds). RealTime measures the passage of time in the external world; it would likely be set to 0 when the machine first starts, but all that matters is that its value increases steadily and accurately. MusicTime is based not on the real world, but on the score; the first event in the score is presumably assigned a MusicTime of 0, and subsequent events are given a MusicTime representing the amount of time that should elapse between the beginning of the piece and an event in the performance. Thus, MusicTime indicates the location in the score.

The machine must keep track of not only of the performer's location in the score, but also the tempo at which the performance is executed. This is measured as RelativeTempo, which is a ratio of the speed at which the performer is playing to the speed of the expected performance. For example, if the performer is playing twice as fast as expected, RelativeTempo is equal to 2.0. The value of RelativeTempo can be calculated at any point in the performance so long as the RealTime at which the performer arrived at any two points x and y of the score is known.

$$\text{RelativeTempo}=(\text{MusicTime}_y-\text{MusicTime}_x)/(\text{RealTime}_y-\text{RealTime}_x).$$

Whenever a known correspondence exists between RealTime and MusicTime, the variables LastRealTime and LastMusicTime are set to the respective current values of RealTime and MusicTime. LastRealTime and LastMusicTime may then be used as a reference for estimating the current value for MusicTime in the following manner:

$$\text{MusicTime}=\text{LastMusicTime}+(\text{RealTime}-\text{LastRealTime})*\text{RelativeTempo}).$$

As the equation above indicates, the performer's location in the score can be estimated at any time using LastMusicTime, LastRealTime, and RelativeTempo (the value of RealTime must always be available to the machine).

The variables described above may be any numerical variable data type which allows time and tempo information to be stored, e.g. a byte, word, or long integer.

Score tracking takes place in either, or both, of two ways: (1) the performance is correlated to the score in the absence of any knowledge or certainty as to which part of the score the musician is performing (referred to below as "Auto-Start" and "Auto-Jump") or (2) the performance is correlated to the score using the performer's current location in the score as a starting point, referred to below as "Normal Tracking."

The Auto-Start or Auto-Jump tracking method makes it possible to (i) rapidly determine the musician's location in the score when the musician begins performing as well as (ii) determining the musician's location in the score should the musician abruptly transition to another part of the score during a performance. Normal Tracking allows the musician's performance to be tracked while the musician is performing a known portion of the score. In some embodiments the score may be initially tracked using "Auto-Start" in order to locate the performer's position in the score. Once the performer's position is located, further performance may be tracked using Normal Tracking.

This score-tracking feature can be used in any number of applications, and can be adapted specifically for each. Examples of possible applications include, but are certainly not limited to: (1) providing a coordinated audio, visual, or audio-visual accompaniment for a performance; (2) synchronizing lighting, multimedia, or other environmental factors to a performance; (3) changing the musical expression of an accompaniment in response to input from the soloist; (4) changing the manner in which a coordinated audio, visual, or audio-visual accompaniment proceeds (such as how brightly a light shines) in response to input from the soloist; (5) producing a real-time analysis of the soloist's performance (including such information as note accuracy, rhythm accuracy, tempo fluctuation, pedaling, and dynamic expression); (6) reconfiguring a performance instrument (such as a MIDI keyboard) in real time according to the demands of the musical score; and (7) correcting the performance of the soloist before the notes of the soloist's performance become audible to the listener. Further, the invention can use standard MIDI files of type 0 or type 1 and may output MIDI Time Code, SMPTE Time Code, or any other proprietary time code that can synchronize an accompaniment or other output to the fluctuating performance (e.g., varying tempo or volume) of the musician General Overview of the Apparatus FIG. 1A shows an overall functional block diagram of the machine 10. In brief overview, the machine 10 includes a score processor 12, an input processor 14, and an output processor 18. FIG. 1A depicts an embodiment of the machine which also includes a user interface 20 and a real-time clock 22 (shown in phantom view). The real-time clock 22 may be provided as an incrementing register, a memory element storing time, or any other hardware or software. As noted above, the real-time clock 22 should provide a representation of time in units small enough to be musically insignificant, e.g. milliseconds. Because the value of RealTime must always be available to the machine 10, if a real-time clock 22 is not provided, one of the provided elements must assume the duty of tracking real-time. The conceptual units depicted in FIG. 1A may be provided as a combined whole, or various units may be combined in orders to form larger conceptual sub-units, for example, the input processor and the score processor need not be separate sub-units.

The score processor 12 converts a musical score into a representation that the machine 10 can use, such as a file of information. The score processor 12 does any necessary pre-processing to format the score. For example, the score processor 12 may load a score into a memory element of the machine from a MIDI file or other computer representation, change the data format of a score, assign importance attributes to the score, or add other information to the score useful to the machine 10. Alternatively, the score processor 12 may scan "sheet music," i.e., printed music scores, and perform the appropriate operations to produce a computer representation of the score usable by the machine 10. Also, the score processor 12 may separate the performance score from the rest of the score ("the accompaniment score").

In embodiments of the machine 10 including a user interface 20 (shown in phantom view) the user interface 20 provides a means for communication in both directions between the machine and the user (who may or may not be the same person as the performer). The user interface 20 may be used to direct the score processor 12 to load a particular performance score from one or more mass storage devices. The user interface 20 may also provide the user with a way to enter other information or make selections. For example, the user interface 20 may allow the performer to assign importance attributes (discussed below) to selected portions of the performance score.

The processed performance score is made available to the input processor 14. The performance score may be stored by the score processor 12 in a convenient, shared memory element of the machine 10, or the score processor 12 may store the performance score locally and deliver it to the input processor 14 as the input processor requires additional portions of the performance score.

The input processor 14 receives performance input. Performance input can be received as MIDI messages, one note at a time. The input processor 14 compares each relevant performance input event (e.g. each note-on MIDI message) with the processed performance score. The input processor may also keep track of performance tempo and location, as well as volume level, if volume information is desireable for the implementation. The input processor 14 sends and receives such information to at least the output processor 18.

The output processor 18 creates an output stream of tracking information which can be made to be available to a "larger application" (e.g. an automatic accompanist) in whatever format needed. The output stream may be an output stream of MIDI codes or the output processor 18 may directly output musical accompaniment. Alternatively, the output stream may be a stream of signals provided to a non-musical accompaniment device.

Figure 1B:
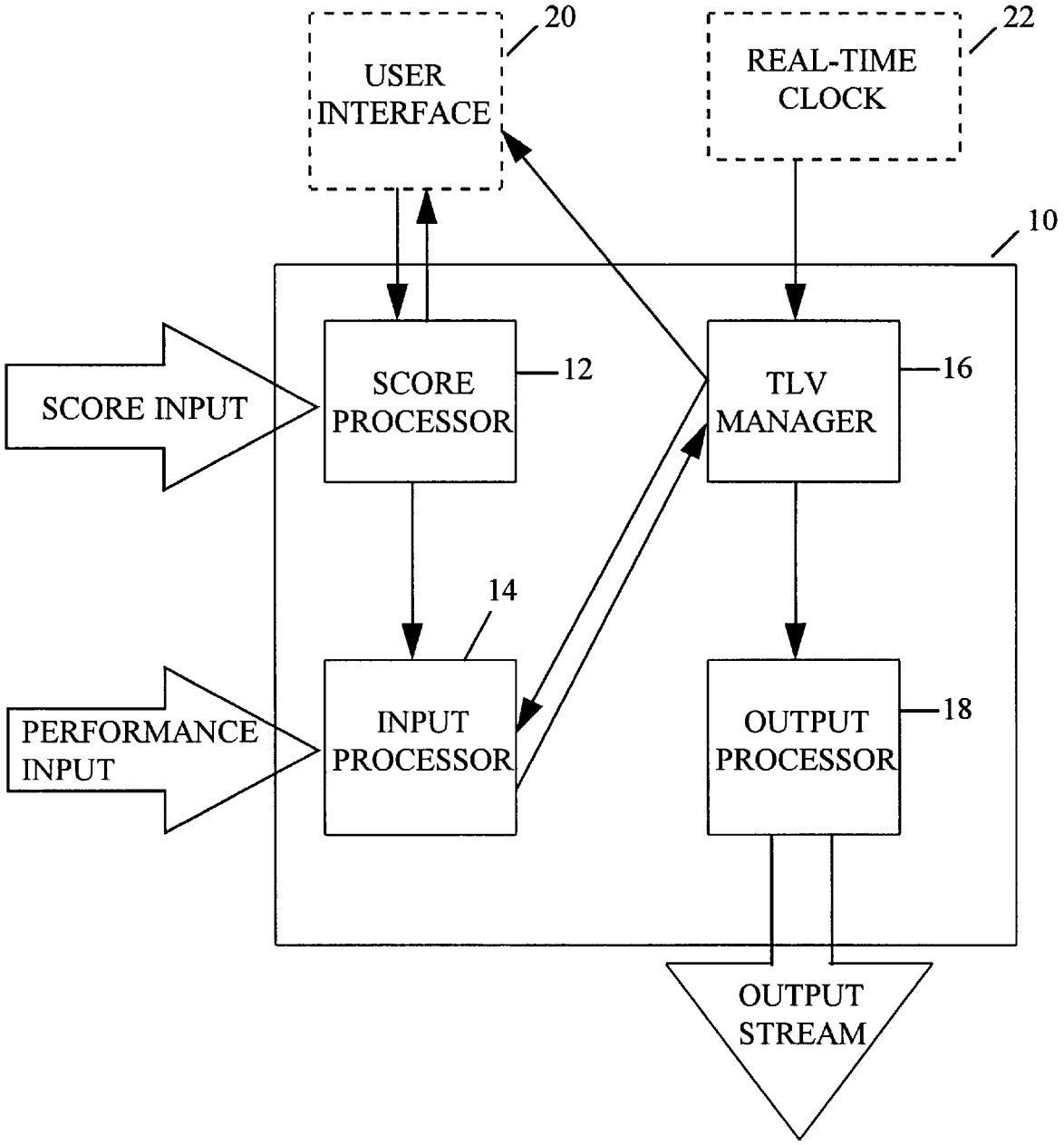
FIG. 1B is a functional block diagram of an embodiment of an apparatus for correlating a performance to a score.

FIG. 1B depicts an embodiment of the system in which the tasks of keeping track of the performance tempo and location with respect to the score, as well as volume level, if volume information is desirable for the implementation, has been delegated to a separate subunit called the tempo/location/volume manager 16. In this embodiment, the input processor 14 provides information regarding score correlation to the TLV manager 16. The TLV manager stores and updates tempo and location information and sends or receives necessary information to and from the input processor 14, the output processor 18, as well as the user interface 20 and the real-time clock 22, if those functions are provided separately.

Figure 2:
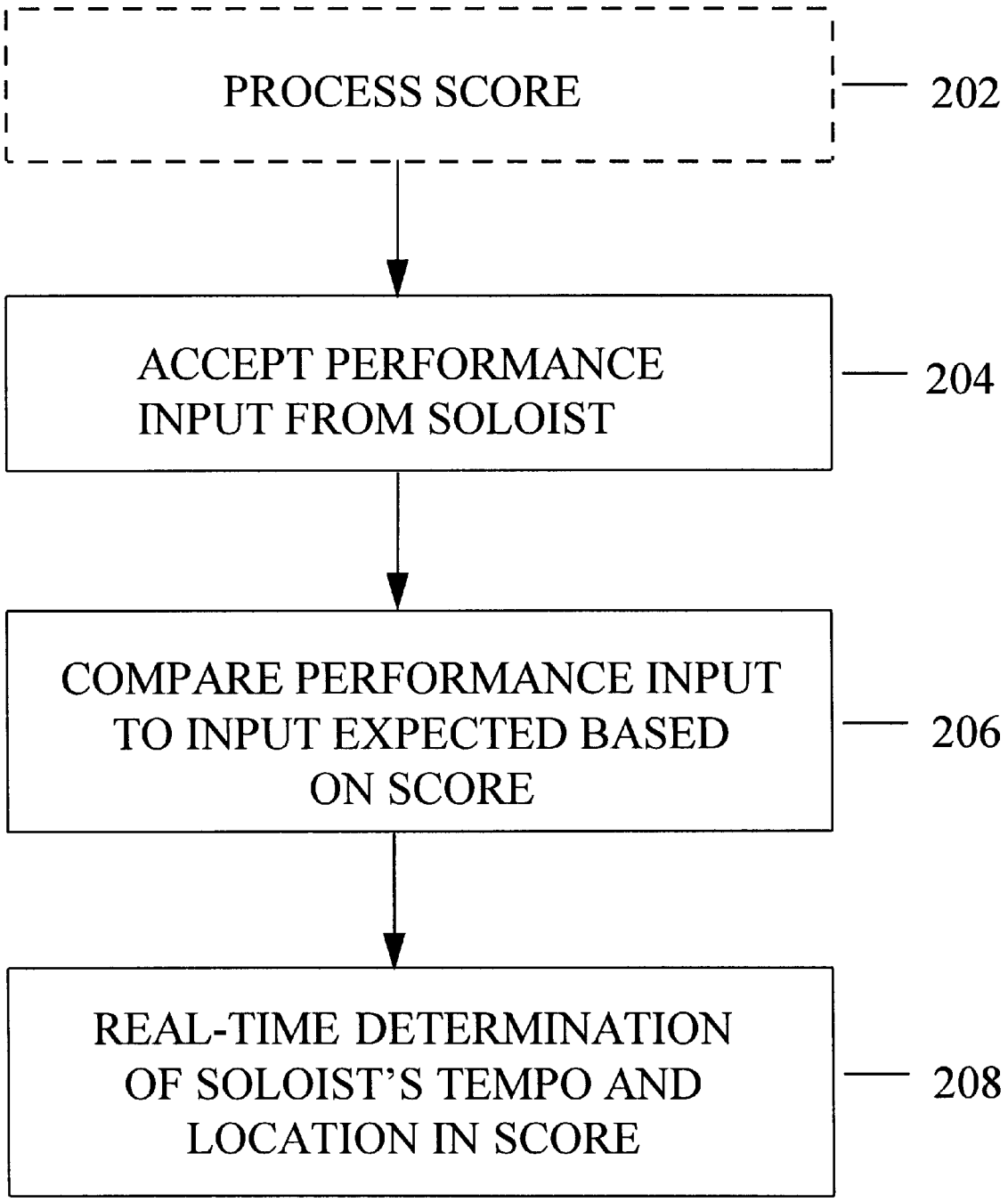
FIG. 2 is a schematic flow diagram of the overall steps to be taken in correlating a performance input to a score.

FIG. 2 is flowchart representation of the overall steps to be taken in tracking an input performance. In brief overview, a score may be processed to render it into a form useable by the machine 10 (step 202, shown in phantom view), performance input is accepted from the performer (step 204), the performance input is compared to the expected input based on the score (step 206), and a real-time determination of the performance tempo, performance location, and perhaps performance volume, is made (step 208). Steps 204, 206, and 208 are repeated for each performance input received.

Description of the Score Processor

The score represents the expected performance. An unprocessed score consists of a number of notes and chords arranged in a temporal sequence. After processing, the score consists of a series of chords, each of which consists of one or more notes. The description of a chord includes the following: its MusicTime, a description of each note in the chord (for example, a MIDI system includes note and volume information for each note-on event), and any importance attributes associated with the chord. The description of each chord should also provide a bit, flag, or some other device for indicating whether or not each note has been matched, and whether or not the chord has been matched. Additionally, each chord's description could indicate how many of the chord's notes have been matched.

As shown in FIG. 2, a musical score may be processed into a form useable by the machine 10. Processing may include translating from a particular electronic form, e.g. MIDI, to a form specifically used by the machine 10, or processing may require that a printed version of the score is converted to an electronic format. In some embodiments, the score may be captured while an initial performance is executed, e.g. a jazz "jam" session. In some embodiments the score may be provided in a format useable by the machine 10, in which case no processing is necessary and step 202 could be eliminated.

Figure 3:
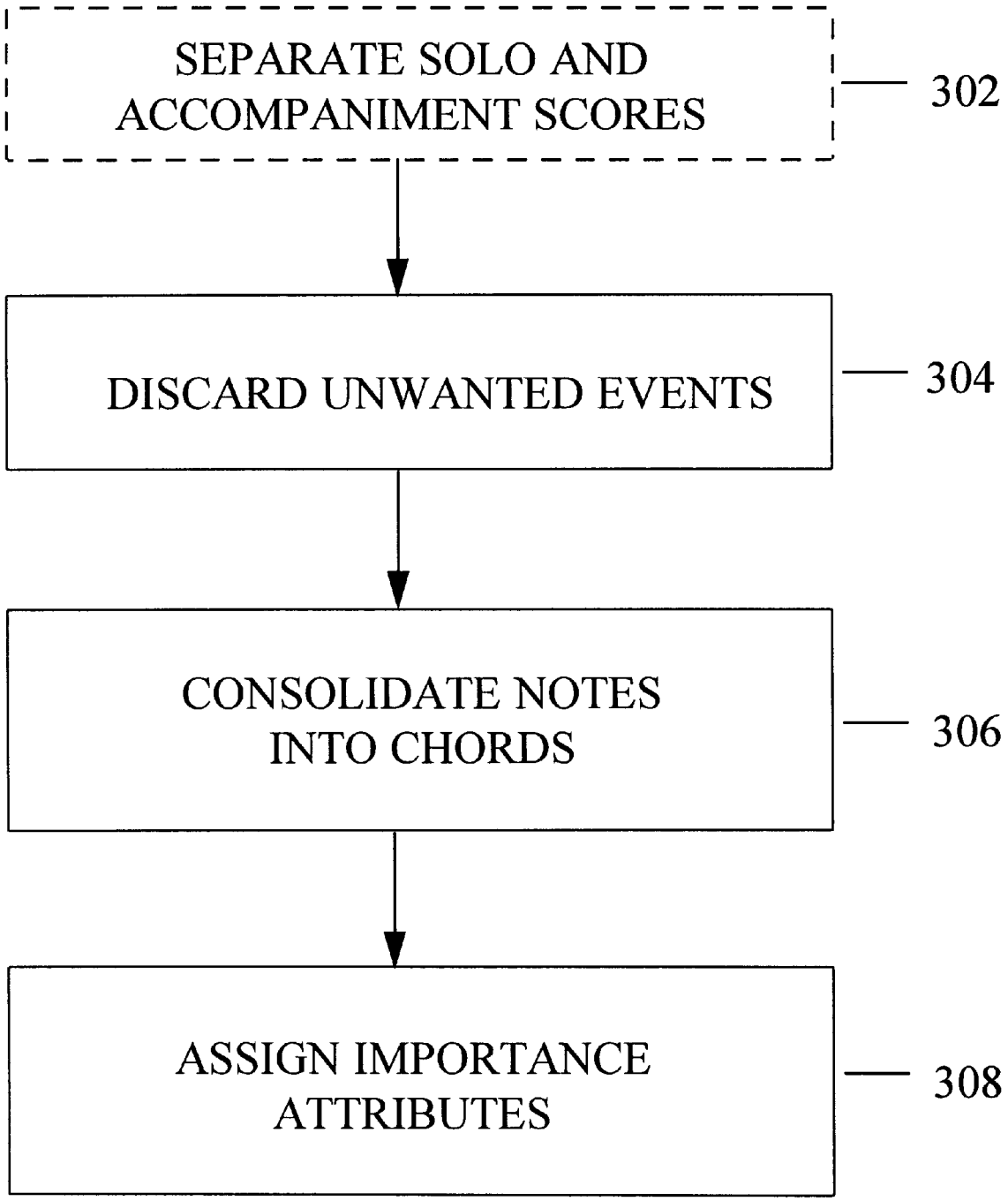
FIG. 3 is a schematic flow diagram of the steps to be taken in processing a score.

Referring now to FIG. 3, the steps to be taken in processing a score are shown. Regardless of the original form of the score, the performance score and the accompaniment score are separated from each other (step 302, shown in phantom view), unless the score is provided with the performance score already separated. The accompaniment score may be saved in a convenient memory element that is accessible by at least the output manager 18. Similarly, the performance score may be stored in a memory element that is shared by at least the input processor 14 and the score processor 12.

Alternatively, the score processor 12 may store both the accompaniment score and the performance score locally and provide portions of those scores to the input processor 14, the output manager 18, or both, upon request.

The score processor 12 begins performance score conversion by discarding events that will not be used for matching the performance input to the score (for example, all MIDI events except for MIDI "note-on" events) (step 304). In formats that do not have unwanted events, this step may be skipped.

Once all unwanted events are discarded from the performance score, the notes are consolidated into a series of chords (step 306). Notes within a predetermined time period are consolidated into a single chord. For example, all notes occurring within a 50 millisecond time frame of the score could be consolidated into a single chord. The particular length of time is adjustable depending on the particular score, the characteristics of the performance input data, or other factors relevant to the application. In some embodiments, the predetermined time period may be set to zero, so that only notes that are scored to sound together are consolidated into chords.

Once separate notes have been consolidated into chords, each chord is assigned zero or more importance attributes (step 308). Importance attributes convey performance-related and accompaniment information. Importance attributes may be assigned by the machine 10 using any one of various algorithms. The machine must have an algorithm for assigning machine-assignable importance attributes; such an algorithm could vary significantly depending on the application. Machine-assigned importance attributes can be thought of as innate musical intelligence possessed by the machine 10. In addition to machine-assignable importance attributes, importance attributes may be assigned by the user. A user may assign importance attributes to chords in the performance score using the user interface 20, when provided. User assignable importance attributes may be thought of as learned musical intelligence.

The following is a description of various importance attributes which the machine 10 may assign to a given chord, with a description of the action taken when a chord with that particular importance attribute is matched by the input processor 14. The following list is exemplary and not intended to be exhaustive. For example, additional importance attributes may be generated which have particular application to the scores, accompaniments, and applications. This list could vary considerably among various implementations; it is conceivable that an implementation could require no importance attributes. The following exemplary importance attributes would be useful for automatic accompanying applications.

AdjustLocation

If this importance attribute is assigned to a chord or note which is subsequently matched, the machine 10 immediately moves to the chord's location in the score. This is accomplished by setting the variable LastMusicTime to the chord's MusicTime, and setting LastRealTime equal to the current RealTime.

TempoReferencePoint

If this importance attribute is assigned to a subsequently matched chord or note, information is saved so that this point can be used later as a reference point for calculating RelativeTempo. This is accomplished by setting the variable ReferenceMusicTime equal to the MusicTime of matched chord or note, and setting ReferenceRealTime equal to the current value of RealTime.

TempoSignificance

This importance attribute is a value to be used when adjusting the tempo (explained in the next item); this is meaningless unless an AdjustTempo signal is present as well. There might be, for example, four possible values of TempoSignificance: 25%, 50%, 75%, and 100%.

AdjustTempo

If this importance attribute is assigned to a subsequently matched chord or note, the tempo since the last TempoReferencePoint is calculated by dividing the difference of the chord's MusicTime and ReferenceMusicTime by the difference of the current RealTime and ReferenceRealTime, as follows:

$$\text{RecentTempo}=(\text{MusicTime}-\text{ReferenceMusicTime})/(\text{RealTime}-\text{ReferenceRealTime})$$

The calculated value of RecentTempo is then combined with the previous RelativeTempo (i.e. the variable RelativeTempo) with a weighting that depends on the value of TempoSignificance (see above), as follows:

$$\text{RelativeTempo}=(\text{TempoSignificance}*\text{RecentTempo})+((1-\text{TempoSignificance})*\text{RelativeTempo})$$

Thus, for example, if the previous value of RelativeTempo is 1.5 and the RecentTempo is 1.1, a TempoSignificance of 25% would yield a new Tempo of 1.4, a TempoSignificance of 50% would yield 1.3, etc. If a chord has both AdjustTempo and TempoReferencePoint Importance Attributes, the AdjustTempo needs to be dealt with first, or the calculation will be meaningless.

For example, an importance attribute may signal where in a particular measure a chord falls. In this example, which is useful for score-tracking embodiments: an importance attribute could be assigned a value of 1.00 for chords falling on the first beat of a measure; an importance attribute could be assigned a value of 0.25 for each chord falling on the second beat of a measure; an importance attribute could be assigned a value of 0.50 for each chord that falls on the third beat of a measure; and an importance attribute could be assigned a value of 0.75 for each chord that falls on the fourth or later beat of a measure. An even simpler example which might be effective for an application that is only interested in knowing when each chord is played would be assigning to each chord the Adjust Location attribute. (It is possible that these or other algorithms would not be applied at this time by the score processor 12, but "on the fly" by the input processor 14; in such a case, when a given chord is matched, the algorithm would be applied for that chord only to determine its importance attributes, if any.)

The following is an exemplary list of user-assignable importance attributes which may be assigned by the user. The list would vary considerably based on the implementation of the machine; certain implementations could provide no user-assignable importance attributes.

WaitForThisChord

If this importance attribute is assigned to a chord or note, score tracking should not proceed until the chord or note has been matched. In other words, if the chord is performed later than expected, MusicTime will stop moving until the chord or note is played. Thus, the result of the formula given above for calculating MusicTime would have to check to ensure that it is not equal to or greater than the MusicTime of an unmatched chord or note also assigned this importance attribute. When the chord or note is matched (whether it's early, on time, or late), the same actions are taken as when a chord assigned the AdjustLocation importance attribute is matched; however, if the chord has the AdjustTempo importance attribute assigned to it, that attribute could be ignored. The effect of this attribute would be that, in an automatic accompaniment system, the accompaniment would wait for the performer to play the chord before resuming.

RestoreTempo

If this importance attribute is assigned to a chord or note which is subsequently matched, the tempo should be reset to its default value; this can be used, for example, to signal an "a tempo" after a "ritard" in the performance. The value of RelativeTempo is set to its default value (usually 1.0), rather than keeping it at its previous value or calculating a new value.

WaitForSpecialSignal

This importance attribute can be used for a number of purposes. For example, it may signify the end of an extended cadenza passage (i.e. a section where the soloist is expected to play many notes that are not in the score). The special signal could be defined, perhaps by the user, to be any input distinguishable from performance input (e.g. a MIDI message or a note the useer knows will not be used during the cadenza passage). An unusual aspect of this importance attribute is that it could occur anywhere in the piece, not just at a place where the soloist is expecting to play a note; thus a different data structure than the normal chord format would have to be used—perhaps a chord with no notes. This attribute is similar to WaitForThisChord, in that the formula for calculating MusicTime would have to check to ensure that the result is at least one time unit less than the MusicTime of this importance attribute, and that, when the special signal is received, the same actions are taken as when a chord with the AdjustLocation importance attribute is matched. The effect in the example above would be that the automatic accompaniment would stop while the musician performs the cadenza, and would not resume until a special signal is received from the performer.

IgnorePerformer

The user could select a certain portion of the score as a section where the performer should be ignored, i.e., the tracking process would be temporarily suspended when the performer gets to that part of the score, and the MusicTime would move regularly forward regardless of what the performer plays. As in the case of WaitForSpecialSignal above, this attribute would not be stored in the same way as regular importance attributes, as it would apply to a range of times in the score, not to a particular chord.

Once importance attributes are assigned, whether by the user or by the machine 10, the performance score has been processed. The performance score is then stored in a convenient memory element of the machine 10 for further reference.

The steps described above may be taken seriatim or in parallel. For example, the score processor 12 may discard unwanted events (step 304) from the entire score before proceeding to the consolidation step (step 306). Alternatively, the score processor 12 may discard unwanted events (step 304) and consolidate chords (step 306) simultaneously. In this embodiment, any interlock mechanism known in the art may be used to ensure that notes are not consolidated before events are discarded.

Description of the Input Processor

Returning to FIG. 2, performance input is accepted from the performer in real-time (step 204). Performance input may be received in a computer-readable form, such as MIDI data from a keyboard which is being played by the performer. Additionally, input may be received in analog form and converted into a computer-readable form by the machine 10. For example, the machine 10 may be provided with a pitch-to-MIDI converter which accepts acoustic performance input and converts it to MIDI data.

The performance input received is compared, in real-time, to the expected input based on the performance score (step 206). Comparisons may be made using any combination of pitch, MIDI voice, expression information, timing information, or other information The comparisons made in step 206 result in a real-time determination of the performer's tempo and location in the score (step 208). The comparisons may also be used to determine, in real-time, the accuracy of the performer's performance in terms of correctly played notes and omitted notes, the correctness of the performer's performance tempo, and the dynamic expression of the performance relative to the performance score.

Figure 4:
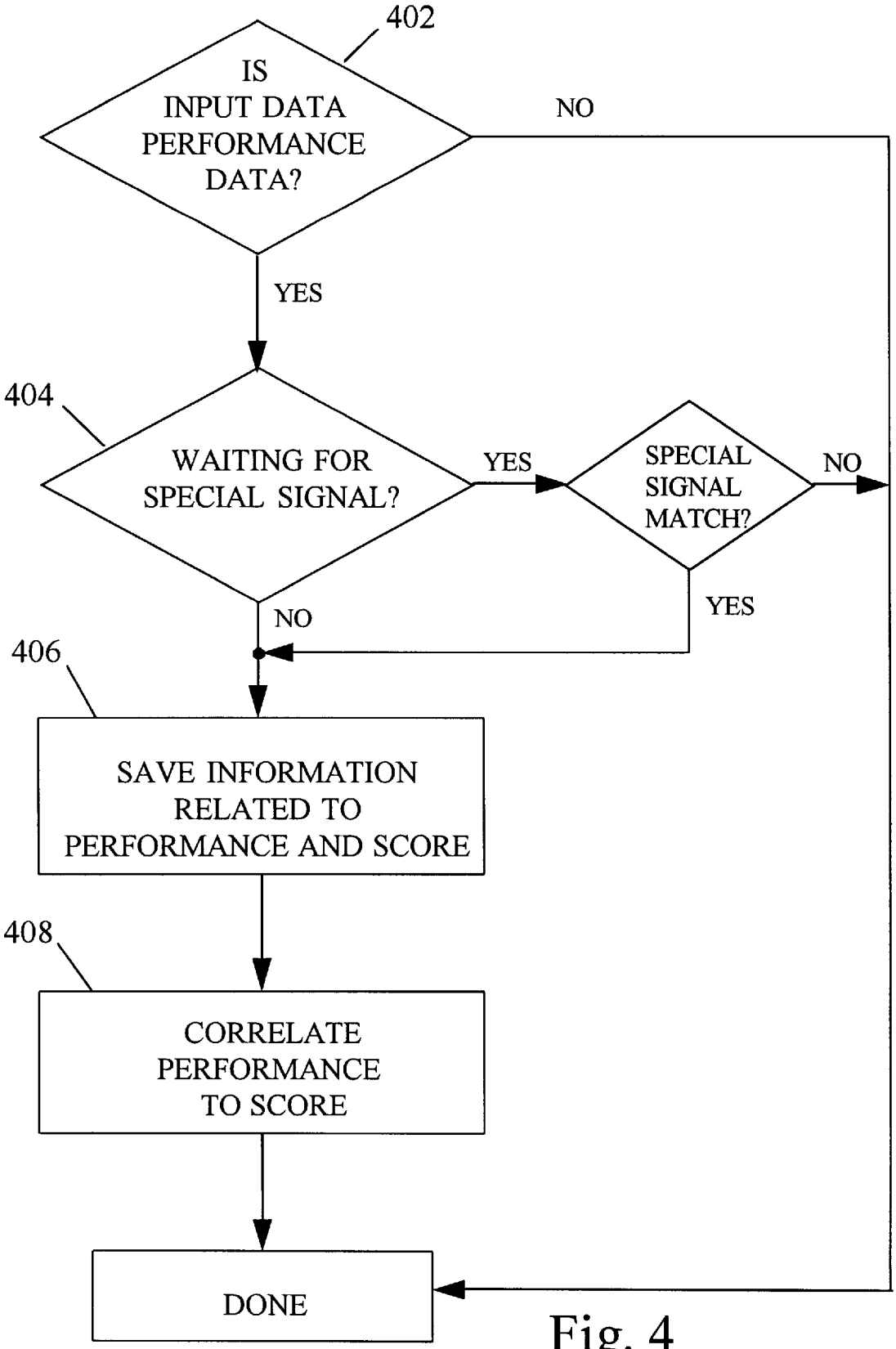
FIG. 4 is a schematic flow diagram of the steps taken by the input processor of FIG. 1.

FIG. 4 is a flowchart representation of the steps taken by the input processor 14 when performance input is accepted. First, the input processor 14 ascertains whether the input data are intended to be control data (step 402). For example, in one embodiment the user may define a certain pitch (such as a note that is not used in the piece being played), or a certain MIDI controller, as signaling a particular control function Any control function can be signaled in this manner including: starting or stopping the tracking process, changing a characteristic of the machine's output (such as the sound quality of an automatic accompaniment), turning a metronome on or off, or assigning an importance attribute. Regardless of its use, if such signal is detected, an appropriate message is sent to the TLV manager 16 (step 410), which in turn may send an appropriate message to the user interface 20 or the output processor 18, and the input processor 14 is finished processing that performance input data. For embodiments in which no TLV manager 16 is provided, the input processor 14 sends an appropriate message directly to the user interface 20 or output processor 18. If the particular embodiment does not support control information being received as performance input, this step may be skipped.

If the data received by the input processor 14 is not control information, then the input processor 14 must determine whether or not the machine 10 is waiting for a special signal of some sort (step 404). The special signal may be an attribute assigned by the user (e.g. WaitForSpecialSignal, discussed above). This feature is only relevant if the machine is in Normal Tracking mode. The performance input data is checked to see if it represents the special signal (step 412); if so, the TLV manager (step 414), if provided, is notified that the special signal has been received. Regardless of whether the input data matches the special signal, the input processor 14 is finished processing the received performance input data.

If the machine 10 is not waiting for a special input signal, the performance input data is checked to determine if it is a note (step 405). If not, the input processor 14 is finished processing the received performance input data. Otherwise, the input processor 14 saves information related to the note played and the current time for future reference (step 406). This information may be saved in an array representing recent notes played; in some embodiments stored notes are consolidated into chords in a manner similar to that used by the score processor 12. The array then might consist of, for example, the last twenty chords played. This information is saved in order to implement the Auto-Start and Auto-Jump features, discussed below.

A different process is subsequently followed depending on whether or not the machine 10 is in Normal Tracking mode (step 407) If it is not, this implies that the machine 10 has no knowledge of where in the score the performer is currently playing, and the next step is to check for an Auto-Start match (step 416). If Auto-Start is implemented and enabled, the input processor 14 monitors all such input and, with the help of the real-time clock 22, it compares the input received to the entire score in an effort to determine if a performance of the piece has actually begun. An Auto-Start match would occur only if a perfect match can be made between a sequence of recently performed notes or chords (as stored in step 406) and a sequence of notes/chords anywhere in the score. The "quality" of such a match can be determined by any number of factors, such as the number of notes/chords required for the matched sequences, the amount of time between the beginning and end of the matched sequences (RealTime for the sequence of performed notes/chords, MusicTime for the sequence of notes/chords in the score), or the similarity of rhythm or tempo between the matched sequences. This step could in certain cases be made more efficient by, for example, remembering the results of past comparisons and only having to match the current note to certain points in the score. In any case, if it is determined that an Auto-Start match has been made, the Normal Tracking process begins. In embodiments providing a TLV manager 16, the input processor 14 sends a message to the TLV manager (step 418) notifying it of the switch to Normal Tracking. Whether or not an Auto-Start match is found, the input processor 14 is finished processing that performance input data. If Auto-Start is not implemented or enabled, this step could be skipped.

Once the Normal Tracking process has begun, the input processor 14, with the help of information from the TLV manager 16 and the real-time clock 22, if provided, compares each relevant performance input event (e.g. each event indicating that a note has been played) with individual notes of the performance score; if a suitable match is found, the input processor 14 determines the location of the performance in the score and its tempo (and perhaps the volume level). The input processor 14 passes its determinations to the TLV manager 16 in embodiments that include the TLV manager 16. If step 407 determined that the Normal Tracking process was already underway, the received performance input data is now ready to be correlated to the performance score (step 408), detailed in FIG. 5.

Figure 5:
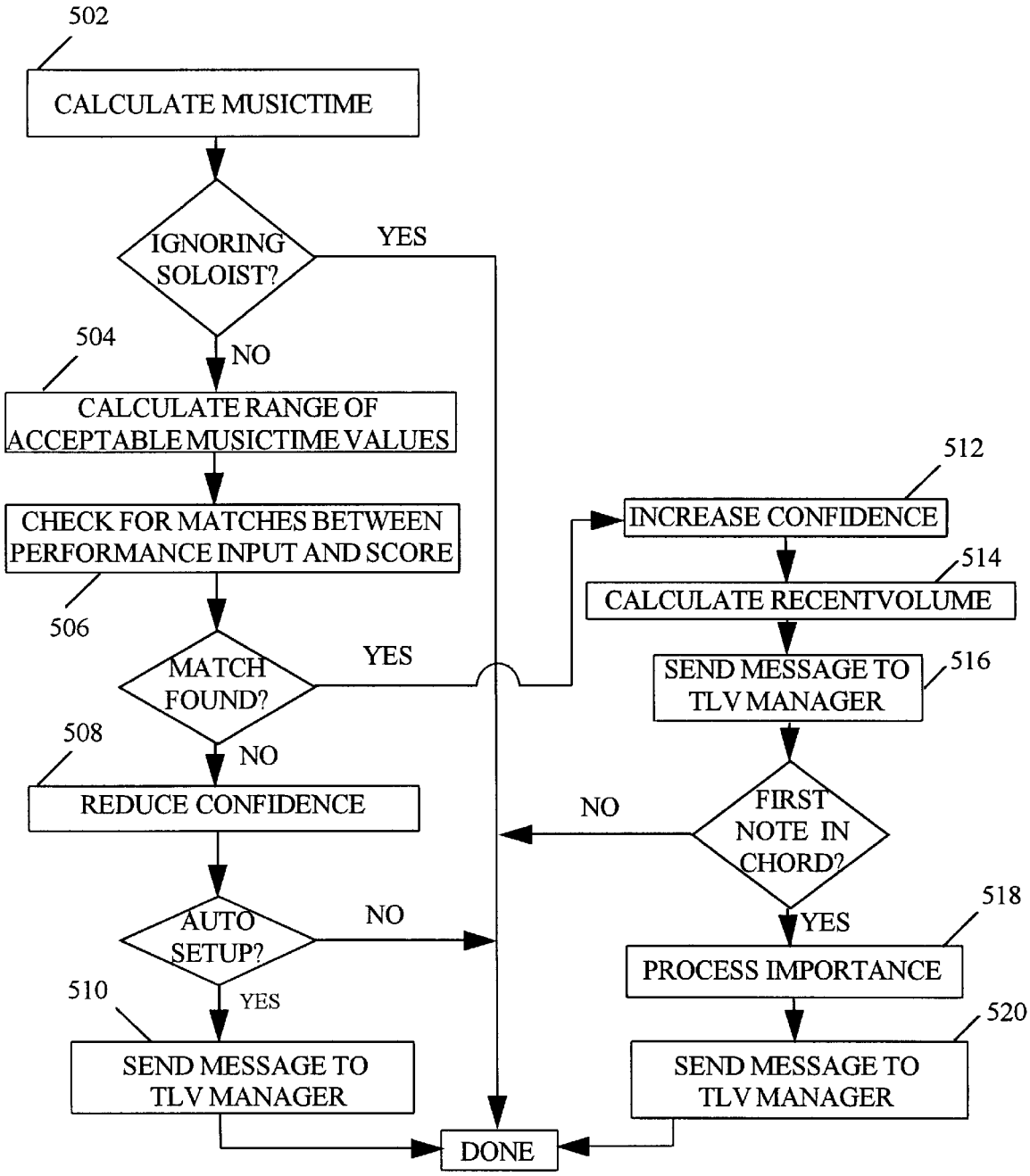
FIG. 5 is a schematic flow diagram of the steps to be taken in correlating a performance input data to a score.

Referring to FIG. 5, the first step is to calculate EstimatedMusicTime (step 502) as described above, which is the machine's best guess of the performer's location in the score.

EstimatedMusicTime may be calculated using the formula for MusicTime above:

EstimatedMusicTime=LastMusicTime+(RealTime−LastRealTime)*RelativeTempo)

In another embodiment, the following formula could be used:

EstimatedMusicTime=LastMatchMusicTime+(RealTime−LastMatchRealTime)*RelativeTempo)

where LastMatchRealTime is the RealTime of the previous match, and LastMatchMusicTime is the MusicTime of the previous match. In another embodiment, both formulas are used: the first equation may be used if there have been no correlation for a predetermined time period (e.g., several seconds) or there has yet to be a correlation (the beginning of the performance); and the second equation may be used if there has been a recent correlation. At any rate, EstimatedMusicTime is a MusicTime, and it gives the machine 10 a starting point in the score to begin looking for a correlation.

The machine 10 uses EstimatedMusicTime as a starting point in the score to begin scanning for a performance correlation A range of acceptable MusicTimes defined by MinimumMusicTime and MaximumMusicTime is calculated (step 504). In genera this may be done by adding and subtracting a value from EstimatedMusicTime. In some embodiments, performance input data that arrives less than a predetermined amount of time after the last performance input data that was matched (perhaps fifty milliseconds), is assumed to be part of the same chord as the last performance input data. In this case, EstimatedMusicTime would be the same as LastMatchMusicTime (the MusicTime of the previously matched chord).

For example, MinimumMusicTime might be set to one hundred milliseconds before the halfway point between EstimatedMusicTime and LastMatchMusicTime or LastMusicTime (whichever was used to calculate EstimatedMusicTime), yet between a certain minimum and maximum distance from EstimatedMusicTime. Similarly, MaximumMusicTime could be set to the same amount of time after EstimatedMusicTime. If it was determined in step 502 that the performance input data is probably part of the same chord as the previously matched performance input data, MinimumMusicTime and MaximumMusicTime could be set very close to, if not equal to, EstimatedMusicTime. In any event, none of MaximumMusicTime, EstimatedMusicTime, and MinimumMusicTime should exceed the MusicTime of an unmatched chord with a WaitForThisChord or WaitForSpecialSignal importance attribute.

Once a range for MusicTime values is established, the performance input event is compared to the score in that range (step 506). Each chord between MinimumMusicTime and MaximumMusicTime should be checked to see if it contains a note that corresponds to the performance input event that has not previously been used for a match until a match is found or until there are no more chords to check. The chords might be checked in order of increasing distance (measured in MusicTime) from EstimatedMusicTime. When a note in the score is matched, it is so marked, so that it cannot be matched again.

If no match is found (step 506), the next step is to look for an Auto-Jump match (step 509); if the Auto-Jump feature is not implemented or is not enabled, this step can be skipped. This process is similar to looking for an Auto-Start Match (step 416), except that different criteria might be used to evaluate the "quality" of the match between two sequences. For example, a preponderance of recent performance input that yielded no match in step 506 (i.e. a number of recent "wrong notes" from the performer) might reduce the "quality," i.e., the number of correctly matched notes, required to determine that a particular sequence-to-sequence match signifies an Auto-Jump match; on the other hand, if the current performance input was the first in a long time that did not yield a match in step 506, it would probably be inappropriate to determine that an Auto-Jump match had been found, no matter how good a sequence-to-sequence match was found. At any rate, if it is determined that an Auto-Jump match has indeed been found, an Auto-Jump should be initiated, and to what location in the score the jump should be made. In embodiments that include a TLV manager 16, a message should be sent to the TLV manager 16 indicating that an Auto-Jump should be initiated (step 510). An Auto-Jump might be implemented simply by stopping the tracking process and starting it again by effecting an Auto-Start at the location determined by the Auto-Jump match. In any case, the match checker 408, and therefore the input processor 14, is now done processing this performance input data.

If a regular (as opposed to Auto-Jump) match is found in step 506, the RelativeVolume, an expression of the performer's volume level compared to that indicated in the score, should be calculated, assuming that volume information is desirable for the implementation (step 514).

RelativeVolume might be calculated as follows:

$$\text{RelativeVolume}=((\text{RelativeVolume}*9)+\text{ThisRelativeVolume})/10$$

where ThisRelativeVolume is the ratio of the volume of the note represented by the performance input event to the volume of the note in the score. The new value of RelativeVolume could be sent to a TLV Manager 16 (step 516), when provided, which would send it to the output processor 18.

The next step is to determine if the match in step 506 warrants declaring that the chord containing the matched note has been matched (step 517) because a matched note does not necessarily imply a matched chord. A chord might be deemed matched the first time one of its notes are matched; or it might not be considered matched until over half, or even all, of its notes are matched. At any rate, if a previously unmatched chord has now been matched, the chord's importance attributes, if any, must be processed, as discussed above (step 518). Any new values of the variables LastMusicTime, LastRealTime, and RelativeTempo are then communicated to the TLV Manager 16 (step 520), if provided.

Operation of the TLV Manager and Output Processor

Returning once again to FIG. 1B and as can be seen from the above description, the TLV Manager 16, when provided, acts as a clearinghouse for information. It receives (sometimes calculates, with the help of a real-time clock 22) and stores all information about tempo (RelativeTempo), location in the score (MusicTime), volume Relative Volume), and any other variables. It also receives special messages from the input processor 14, such as that a special signal (defined as a user-assigned importance attribute) has been received, or that an Auto Jump or Auto Start should be initiated, and does whatever necessary to effect the proper response. In general, the TLV Manager 16 is the supervisor of the whole machine, making sure that all of the operating units have whatever information they need. If no TLV manager 16 is provided, the input processor 14 shoulders these responsibilities.

The output processor 18 is responsible for communicating information to the specific application that is using the machine. This could be in the form of an output stream of signals indicating the values of LastMusicTime, LastRealTime, RelativeTempo, and RelativeVolume any time any of these values change. This would enable the application to calculate the current MusicTime (assuming that it has access to the real-time clock 22), as well as to know the values of RelativeTempo and RelativeVolume at any time. Alternatively, the output processor 18 could maintain these values and make them available to the application when requested by the application. Additionally, the output could include an echo of each received performance input event, or specific information such as whether that note was matched.

EXAMPLE I

One example of a system using the machine 10 would be one that automatically synchronizes a MIDI accompaniment to a performance. Such a system would involve an "accompaniment score" in addition to the score used by the machine 10 (herein called "solo score"), and would output MIDI data from the accompaniment score to whatever MIDI device or devices are connected to the system; the result would be dependent on the devices connected as well as on the contents of the accompaniment score. The MIDI output might also include an echo of the MIDI data received from the performer.

The solo score could be loaded and processed (step 202) by the score processor 12 from one track of a Standard MIDI File (SMF), while the other tracks of the file ("accompaniment tracks") could be loaded as an accompaniment score; this accompaniment score would use the same MusicTime coordinate system used by the solo score, and would likely contain all events from the accompaniment tracks, not just "note-on" events, as is the case with the solo score. The solo score could be processed as it is loaded, or the machine could process the solo score after it is completely loaded. When the performance begins (indicated either through the user interface 20 or by the input processor 14 detecting an Auto-Start), the system begins to "play" (by outputting the MIDI data) the events stored in the accompaniment score, starting at the score location indicated as the starting point. One way this might be effected is that the machine 10 could use an interrupt mechanism to interrupt itself at the time the next event in the accompaniment score is to be "played". The time for this interrupt (a RealTime) could be calculated as follows:

$$\text{InterruptRealTime}=\text{CurrentRealTime}+((\text{NextEventMusicTime}-\text{CurrentMusicTime})/\text{RelativeTempo})$$

Substituting the formula for MusicTime (above) for CurrentMusicTime, this reduces to:

$$\text{InterruptRealTime}=\text{LastRealTime}+((\text{NextEventMusicTime}-\text{LastMusicTime})/\text{RelativeTempo})$$

If this formula produces a result that is less than or equal to the CurrentRealTime (i.e. if NextEventMusicTime is less than or equal to CurrentMusicTime), the interrupt process should be executed immediately.

In applying the above formula for InterruptRealTime, no interrupt should be set up if the NextEventMusicTime is equal to or greater than the MusicTime of either an unmatched chord with the WaitForThisChord importance attribute, or a location in the score marked with the WaitForSpecialSignal importance attribute. This has the effect of stopping the accompaniment until either the awaited chord is matched or the special signal is received (step 414); when the relevant event occurs, new values of the LastMusicTime and LastRealTime are calculated (step 518) by the input processor 14 and an interrupt is set up as described above.

When the interrupt occurs, the system outputs the next MIDI event in the accompaniment score, and any other events that are to occur simultaneously (i.e. that have the same MusicTime). In doing so, the volume of any notes played (i.e. the "key velocity" of "note-on" events) could be adjusted to reflect the current value of RelativeVolume. Before returning from the interrupt process, the next interrupt would be set up using the same formula.

Synchronization could be accomplished as follows: Each performance note is received as MIDI data, which is processed by the input processor 14; any new values of LastMusicTime, LastRealTime, RelativeTempo, or RelativeVolume are sent (steps 516 and 520), via the TLV Manager 16, when provided, and the output processor 18, to the system driving the accompaniment. Whenever the system receives a new value of LastMusicTime, LastRealTime, or RelativeTempo, the pending interrupt would be immediately canceled, and a new one set up using the same formula, but with the new variable value(s).

Examples of ways a user could use such a system might include:

a) The SMF accompaniment track(s) contain standard MIDI musical messages and the output is connected to a MIDI synthesizer. The result is a musical accompaniment synchronized to the soloist's playing.

b) The SME accompaniment track(s) contain MIDI messages designed for a MIDI lighting controller, and the output is connected to a MIDI lighting controller. The result is changing lighting conditions synchronized to the soloist's playing in a way designed by the creator of the SMF.

c) The SMF accompaniment track(s) contain MIDI messages designed for a device used to display still images and the output is connected to such a device. The result is a "slide show" synchronized to the soloist's playing in a way designed by the creator of the SMF. These "slides" could contain works of art a page of lyrics for a song, a page of musical notation, etc.

d) Similarly, SMFs and output devices could be designed and used to control fireworks, canons, fountains, or other such items.

EXAMPLE II

In another example, the system could output time-code data (such as SMPTE time code or MIDI time code) indicating the performer's location in the score. This output would be sent to whatever device(s) the user has connected to the system that are capable of receiving output time-code or acting responsively to output time-codes; the result would be dependent on the device(s) connected.

This machine 10 could be set up almost identically to the previous example, although it might not include an accompaniment score. An interrupt mechanism similar to that used for the accompaniment could be used to output time code as well; if there indeed is an accompaniment score, the same interrupt mechanism could be used to output both the accompaniment and the time-code messages.

Since the time code indicates the performer's location in the score, it represents a MusicTime, not a RealTime. Thus, for each time-code message to be output, the system must first calculate the MusicTime at which it should be sent. (This simple calculation is, of course, dependent on the coordinate systems in which the time-code system and MusicTime are represented; as an example, if 25-frames-per-second SMPTE time code is being used, and MusicTime is measured in milliseconds, a time-code message should be sent every 40 milliseconds, or whenever the value of MusicTime reaches 401, where I is any integer.) Then, the same formula from the previous example can be used to determine the interrupt time. When the interrupt occurs, the system would output the next time-code message, and set up the next interrupt using the same formula.

Synchronization could be accomplished by means almost identical to those used in the previous example. Each performance note is processed by the input processor 14; any new values of LastMusicTime, LastRealTime, or RelativeTempos are sent (steps 516 and 520) through the TLV-Manager 16, when provided, and the output processor 18 to the system driving the accompaniment. Whenever the system receives a new value of LastMusicTime, LastRealTime, or RelativeTempos, the pending interrupt would be immediately canceled, and a new one set up using the same formula, but with the new variable values. In addition, when a new value of LastMusicTime is received (which results from a chord with an AdjustLocation importance attribute being matched by the input processor 14), it might be necessary to send a time-code message that indicates a new location in the score depending on the magnitude of the relocation. However, depending on the desired application, the system might implement a means of smoothing out the jumps rather than jumping directly.

Examples of ways a user could use such a system might include: synchronizing a video to a soloist's performance of a piece; a scrolling display of the musical notation of the piece being played; or "bouncing-ball" lyrics for the song being played. And, as mentioned above, the system could output both a MIDI accompaniment, as in the previous example, and time code, as in this example.

EXAMPLE III

In another example, the system could be used to automatically change the sounds of a musician's instrument at certain points in the score, similar to automatically changing the registration on a church organ during the performance of a piece. This application could be accomplished using the system of Example I above, with the following further considerations: the SME accompaniment track(s), and therefore the accompaniment score, should contain only MIDI messages designed to change the sound of an instrument (MIDI program-change messages); the performer's instrument should be set to not produce sound in response to the performer's playing a note; and the output stream, which should include an echo of the MIDI data received from the performer, should be connected to any MIDI synthesizer, which may or may not be the instrument being played by the performer. Thus, as the performer plays, a synchronized accompaniment, consisting of only MIDI program-change messages, will be output along with the notes of the live performance, and the sounds of the performance will be changed appropriately.

One further consideration would in many cases provide a more satisfactory result: the notes of the performance should be echoed to the output stream only after they have been fully processed by the input processor 14 and any resultant accompaniment (i.e. MIDI program-change messages) have been output by the system. To fully appreciate the advantages provided by this feature, consider the situation where the performance score contains a one-note chord with the AdjustLocation importance attribute and with a given MusicTime, and the accompaniment score contains a MIDI program-change message with the same MusicTime, indicating that the sound of the instrument should be changed when the performer plays that note. When the performer plays the note that is matched to the relevant chord: If the performance note is echoed immediately to the synthesizer, the note would sound first with the "old" sound; meanwhile, the note is processed by the input processor 14, causing a new value of LastMusicTime and LastRealTime to be set (step 518), in turn causing the system to output the program-change message; when this happens either the note which is already sounding with the "old" sound is stopped from sounding or is changed to the "new" sound, neither of which is satisfactory. However if the performance note is not echoed until after being processed by the input processor 14, the "new" sound will have already been set up on the synthesizer, and the note will sound using the expected sound.

EXAMPLE IV

In another example, the machine 10 could be configured to correct performance mistakes made by the performer before the sounds are actually heard. There are a number of ways this could be effected, one of which uses the system of Example I above, with the following considerations: the accompaniment score is loaded from the solo track of the SMF (i.e. the same track that is used to load the performance score) instead of from the non-solo tracks; the performer's instrument should be set not to produce sound in response to the performer's playing a note; and the output stream, which should not include an echo of the performer's MIDI data, should be connected to any MIDI synthesizer, which may or may not be the instrument being played by the performer. Thus, as the performer plays, a synchronized "accompaniment", consisting of the MIDI data from the original solo track, will be output. The effect is a "sanitized" performance consisting of the notes and sounds from the original solo track, but with timing and general volume level adjusted according to the performer's playing.

Other possible systems effecting this process could provide differing degrees to which the output performance reflects the original solo track and to which it reflects the actual performance. Some of these systems might involve a re-configuration of the workings of the machine 10. For example, one system might involve changing the input processor 14 so that it would cause each matched performance note to be output directly while either ignoring or changing unmatched (i.e. wrong) notes.

EXAMPLE V

In yet another embodiment, the machine 10 could provide analysis of various parameters of an input performance; this might be particularly useful in practice situations. For example, a system could automatically provide some sort of feedback when the performer plays wrong notes or wrong rhythms, varies the tempo beyond a certain threshold, plays notes together that should not be together or plays notes separately that should be together, plays too loud or too soft, etc. A simple example would be one in which the system receives values of RelativeTempo, RelativeVolume, LastMusicTime, and LastRealTime from the output processor 18 and displays the performer's location in the piece as well as the tempo and volume level relative to that expected in the score.

Other possible systems effecting this process could provide analyses of different aspects of the performance. Some of these systems might involve a reconfiguration of the workings of the machine 10, possibly requiring the input processor 14 to output information about each received note.

EXAMPLE VI

The machine 10 could be designed to save the performance by storing each incoming MIDI event as well as the RealTime at which it arrived. The performance could then be played back at a later time, with or without the accompaniment or time-code output; it could also be saved to disk as a new SMF, again with or without the accompaniment.

The playback or the saved SMF might incorporate the timing of the performance; in that case the timing of the accompaniment could be improved over what occurred during the original performance, since the system would not have to react to the performance in real time. Indeed, during the original performance, the input processor 14 can notice a change in tempo only after it has happened (step 518), and the tempo of the accompaniment will only change after it has been so noticed; in a playback or in the creation of a new SMF, the tempo change can be effected at the same point in the music where it occurred in the performance.

There are a number of playback/saving options that could either be determined by the system or set by the user, for example: whether to use the timing from the original performance or from the original SMF; if the timing of the original performance is used, whether to make the adjustment to the accompaniment described in the previous paragraph or to output the accompaniment exactly as it was played during the original performance; whether to use the actual notes from the original performance, or to output a sanitized version of the solo part-incorporating the timing of the performance but the MIDI data from the solo track of the SMF; whether to output the volumes from the original performance or from the corresponding notes in the performance score, etc.

For example, by recording a performance and then saving it with the accompaniment as a new SMF using the timing of the performance but the notes from the original SMF, a SMF can be created that might more closely represent the expected timing of a given performer, even if the performance was less than 100% accurate. If this new SMF is used for subsequent score tracking, the accompaniment might be better synchronized to the performance; thus the creation of the new SMF might be thought of as representing a "rehearsal" with the performer.

The apparatus of the present invention may be provided as specialized hardware performing the functions described herein, or it may be provided as a general-purpose computer running appropriate software. When reference is made to actions which the machine 10 takes, those actions may be taken by any subunit of the machine 10, i.e., those actions may be taken by the input processor 14, the TLV manager 16, the score processor 12 or the output processor 18. The selection of the processor to be used in performing a particular task is an implementation specific decision.

A general-purpose computer programmed appropriately in software may be programmed in any one of a number of languages including PASCAL, C, C++, BASIC, or assembly language. The only requirements are that the software language selected provide appropriate variable types to maintain the variables described above and that the code is able to run quickly enough to perform the actions described above in real-time.

While the invention has been particularly shown and described with reference to specific preferred embodiments, it should be understood by those skilled in the art that various changes in form and detail may be made without departing from the spirit and scope of the invention as defined by the appended claims.

What is claimed is:

1. A method for real-time tracking of a musical performance in relation to a score of the performed piece, the method comprising the steps of:

(a) receiving each note of the musical performance as it occurs;

(b) determining, for each received note, a range of the score in which the note is expected to occur; and (c) determining, for each received note, if the received note occurs in the determined range of the score.

2. The method of claim 1 further comprising the steps of:

(d) providing a coordinated accompaniment if the received note occurs in the determined range of the score.

3. The method of claim 1 wherein step (b) further comprises:

(b-a) determining the tempo at which the performance is occurring;

(b-b) calculating the time elapsed between the receipt of the note and the receipt of the last note that correlated to the score; and (b-c) using the calculated elapsed time and the determined tempo to determine a range of the score in which the received note is expected to occur.

4. The method of claim 1 wherein step (c) further comprises determining, for each note the received, if the received note occurs in the determined range of the score and has not been previously matched.

5. The method of claim 1 further comprising the step of processing the score of the performed piece before step (a).

6. The method of claim 5 wherein the processing step further comprises:

(a) discarding events from the score;

(b) consolidating notes into chords; and (c) assigning importance attributes to notes.

7. The method of claim 6 wherein step (b) further comprises:

(b-a) identifying at least one note expected to occur within a predetermined time range of the score; and (b-b) consolidating the identified notes into a chord.

8. The method of claim 1 further comprising the steps of:

(d) storing information associated with each received note; and (e) scanning the entire score to determine if a sequence of stored notes matches a portion of the score of the performed piece.

9. The method of claim 1 further comprising the step of associating information with at least one note of the score.

10. The method of claim 9 further comprising the step of providing a coordinated accompaniment responsive to the associated information.

11. An apparatus for real-time tracking of a musical performance in relation to a score of the performed piece, the apparatus comprising:

an input processor which receives each note of a performance input as it occurs, stores each received note and information associated with each received note in a memory element, determines, for each received note, a range of the score in which the note is expected to occur, and compares each received note to the score of the performed piece to determine if the received note matches the determined range of the score; and an output manager which receives a signal from said input processor and provides an output stream responsive to the received signal.

12. The apparatus of claim 11 wherein the output stream is a coordinated accompaniment to the performance.

13. The apparatus of claim 11 further comprising a tempo/location/volume manager that determines whether a chord has been matched responsive to receiving a signal from said input processor indicating a note has matched the score.

14. The apparatus of claim 11 further comprising a user interface in communication with the input processor.

15. The apparatus of claim 11 further comprising a real-time clock which provides an output to said input processor.

16. An article of manufacture having computer-readable program means for real-time tracking of a musical performance in relation to a score of the performed piece embodied thereon, the article of manufacture comprising:

(a) computer-readable program means for receiving each note of the musical performance as it occurs;

(b) computer-readable program means for determining, for each received note, a range of the score in which the note is expected to occur; and (c) computer-readable program means for determining, for each received note, if the received note occurs in the determined range of the score.

17. The article of claim 16 further comprising:

(d) computer-readable program means for providing a coordinated accompaniment if the received note occurs in the determined range of the score.

18. The article of manufacture of claim 16 wherein said computer-readable program means for determining a range of the score further comprises (b-a) computer-readable program means for determining the tempo at which the performance is occurring;

(b-b) computer-readable program means for calculating the time elapsed between the receipt of the note and the receipt of the last note that correlated to the score; and (b-c) computer-readable program means for using the calculated elapsed time in the determined tempo to determine a range of the score in which the received note is expected to occur.

19. The article of manufacture of claim 16 wherein said computer-readable program means for determining if the received note occurs in the determined range of the score further comprises computer-readable program means for determining, for each note received, if the received note occurs in the determined range of the score and has not been previously matched.

20. The article of manufacture of claim 16 further comprising computer-readable program means for associating information with at least one note of the score.

* * * * *

UNITED STATES PATENT AND TRADEMARK OFFICE

CERTIFICATE OF CORRECTION

PATENT NO. : 6,107,559

DATED : AUGUST 22, 2000

INVENTOR(S) : WEINSTOCK ET AL.

It is certified that error appears in the above-identified patent and that said Letters Patent is hereby corrected as shown below:

On the title page, under "Related U.S. Application Data," please insert --[63] Continuation of U.S. Patent No. 5,952,597, June 19, 1997.--

Column 1, line 8, after "application please insert--is a continuation of United States Patent No. 5,952,597, filed June 19, 1997, which itself--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*